US012668957B2

(12) United States Patent
Ye et al.

(10) Patent No.: US 12,668,957 B2
(45) Date of Patent: Jun. 30, 2026

(54) FAUCET

(71) Applicant: Xiamen Lota International Co., Ltd., Xiamen (CN)

(72) Inventors: Liming Ye, Xiamen (CN); Shuanglin Bai, Xiamen (CN); Chuanbao Zhu, Xiamen (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 23 days.

(21) Appl. No.: 18/974,908

(22) Filed: Dec. 10, 2024

(65) Prior Publication Data

US 2026/0043220 A1 Feb. 12, 2026

(30) Foreign Application Priority Data

Aug. 6, 2024 (CN) ..... 202421892441.2

(51) Int. Cl.
*E03C 1/04* (2006.01)

(52) U.S. Cl.
CPC ..... *E03C 1/0401* (2013.01)

(58) Field of Classification Search
CPC ..... E03C 1/0401
See application file for complete search history.

(56) References Cited

U.S. PATENT DOCUMENTS 5,822,811 A * 10/1998 Ko ..... E03C 1/0401 4/678
6,079,447 A * 6/2000 Holzheimer ..... E03C 1/0401 4/677
2003/0051758 A1* 3/2003 Brandebusemeyer ..... E03C 1/0401 137/801
2009/0277520 A1* 11/2009 Wang ..... E03C 1/0401 137/801
2013/0186479 A1* 7/2013 Zhu ..... E03C 1/06 137/15.01
2013/0333109 A1* 12/2013 Li ..... E03C 1/0402 4/695
2019/0376608 A1* 12/2019 Tsuruda ..... F16K 19/006

* cited by examiner

*Primary Examiner* — Patrick C Williams
(74) *Attorney, Agent, or Firm* — Cooper Legal Group, LLC

(57) ABSTRACT

A faucet includes a housing, a countertop mounting assembly, a fixed seat, a valve assembly, and a water outlet pipe. The countertop mounting assembly includes a mounting seat and a locking assembly, and the mounting seat is operatively coupled to at least part of the locking assembly to drive the at least part of the locking assembly to abut a lower side of a countertop to secure the mounting seat to the countertop. The valve assembly, the fixed seat, and the mounting seat are arranged in sequence along an axial direction. The fixed seat and the mounting seat define a pipe penetration space, a notch is defined and is connected to the pipe penetration space, and the notch corresponds to the second housing. The water outlet pipe can pass through the notch and pass out from the pipe penetration space.

11 Claims, 9 Drawing Sheets

FAUCET

RELATED APPLICATIONS

This application claims priority to Chinese patent application number 202421892441.2, filed on Aug. 6, 2024. Chinese patent application number 202421892441.2 is incorporated herein by reference.

FIELD OF THE DISCLOSURE

The present disclosure relates to the technical field of sanitary products and in particular to a faucet.

BACKGROUND OF THE DISCLOSURE

In existing technology, single-handle basin faucets are typically installed and fixed using an under-countertop nut structure. A single-handle basin faucet generally comprises a water outlet faucet and a valve assembly. The water outlet faucet comprises a faucet body and a threaded pipe fixedly connected to the faucet body. The valve assembly is connected to the faucet body. The threaded pipe passes through an installation hole on a countertop and corresponds to an underside of the countertop. A nut is screwed onto the threaded pipe until the nut abuts the underside of the countertop, after which a water connection is made.

However, for the single-handle faucets, there is another issue related to a water pipe installation. One end of a water outlet pipe is connected to the valve assembly and passes down through the countertop. But the single-handle faucet typically also comprises a lateral housing. The other end of the water outlet pipe needs to pass through a vertical housing and then into the lateral housing. This installation is complicated, and a large space must be reserved between the vertical and lateral housings for the water pipe installation. The installation is cumbersome and involves multiple steps.

BRIEF SUMMARY OF THE DISCLOSURE

The technical problem to be solved by the present disclosure is to provide a faucet.

In order to solve the above technical problems, the present disclosure provides a faucet comprising a housing, a countertop mounting assembly, a fixed seat, a valve assembly, and a water outlet pipe.

The housing comprises a first housing and a second housing, and one end of the second housing is connected to a side of a top part of the first housing. The countertop mounting assembly comprises a mounting seat and a locking assembly, and at least part of the locking assembly is disposed below the mounting seat. The mounting seat is operatively coupled to the at least part of the locking assembly to drive the at least part of the locking assembly to abut a lower side of a countertop to secure the mounting seat to the countertop. The valve assembly is disposed on an upper end of the first housing, and the fixed seat is disposed on a lower end of the first housing. The lower end of the first housing is detachably sleeved on the mounting seat, and the valve assembly, the fixed seat, and the mounting seat are arranged in sequence along an axial direction of the first housing. The fixed seat and the mounting seat define a pipe penetration space, and a notch is defined between the valve assembly and the fixed seat and is connected to the pipe penetration space. The notch corresponds to the second housing. A first end of the water outlet pipe is connected to a distal end of the second housing, and a second end of the water outlet pipe is configured to pass through the notch and pass out from the pipe penetration space.

In a preferred embodiment, the notch comprises a first position-providing part and a second position-providing part, and a lower end of the valve assembly comprises the first position-providing part. The fixed seat comprises the second position-providing part. The first position-providing part is a groove wall formed on the lower end of the valve assembly, and the second position-providing part is a through groove.

In a preferred embodiment, a top wall of the groove wall extends to point to an entrance of the second housing.

In a preferred embodiment, the valve assembly comprises a valve seat, at least one water inlet pipe, and a water-mixing pipe, the valve seat is configured to abut the fixed seat. The at least one water inlet pipe and the water-mixing pipe are connected to the valve seat, and the at least one water inlet pipe and the water-mixing pipe are configured to pass out from the pipe penetration space. The water-mixing pipe is detachably connected to the water outlet pipe.

In a preferred embodiment, the faucet further comprises a connector, and the connector is respectively detachably connected to the water outlet pipe and the water-mixing pipe.

In a preferred embodiment, the mounting seat comprises a buckle member, and the lower end of the first housing is configured to be sleeved outside the mounting seat. The lower end of the first housing comprises a buckle hole, and the buckle member is operatively buckled to the buckle hole.

In a preferred embodiment, the fixed seat comprises a cantilever, and the cantilever is disposed with a button. The button is configured to be pressed by an external force to enable the cantilever to move radially inward, and the cantilever is configured to push the buckle member to move radially to leave the buckle hole. The buckle member is configured to be elastically deformed to be rotated around a lower end of the buckle member, and the buckle member comprises a buckle protrusion. An outer side of an upper end of the buckle member comprises an engaging groove, and the cantilever is configured to be elastically deformed to be rotated around an upper end of the cantilever. A lower end of the cantilever is correspondingly engaged with the engaging groove. When the button on the cantilever is pressed by the external force to rotate radially inward, the lower end of the cantilever pushes the upper end of the buckle member to move radially inward so that the buckle protrusion leaves the buckle hole.

In a preferred embodiment, the lower end of the first housing comprises a button hole, and a button of a cantilever of the fixed seat protrudes from the button hole to enable the fixed seat to be detachably connected to the first housing.

In a preferred embodiment, the buckle hole and the button hole are arranged side by side along a vertical direction of the faucet.

In a preferred embodiment, an outer wall of the fixed seat further comprises a plurality of ribs, and the plurality of ribs abut an inner wall of the first housing.

In a preferred embodiment, the locking assembly comprises a threaded column, a moving member, an abutting member, a blocking head, and two guiding pins. The threaded column is operably rotatably disposed on the mounting, and the moving member is screwed on the threaded column. When the threaded column is rotated, the moving member is configured to move up and down along the threaded column to abut the lower side of the countertop. The blocking head is located below the mounting seat, and the two guiding pins are connected to the blocking head and the mounting seat. The moving member is slidably disposed on the two guiding pins, and the abutting member comprises two rotating rods. The two rotating rods are respectively rotatably connected to two sides of the moving member, and a rotation center of each of the two rotating rods deviates from a middle position of a corresponding one of the two rotating rods.

Compared with the existing technology, the technical solution of the present disclosure has the following beneficial effects.

The countertop mounting assembly comprises the mounting seat and the locking assembly. The at least part of the locking assembly is disposed below the mounting seat, and the mounting seat is operatively coupled to the at least part of the locking assembly to drive the at least part of the locking assembly to abut the lower side of the countertop to secure the mounting seat to the countertop. The valve assembly is disposed on the upper end of the first housing, and the fixed seat is disposed on the lower end of the first housing. The lower end of the first housing is detachably sleeved on the mounting seat, and the valve assembly, the fixed seat, and the mounting seat are arranged in sequence along the axial direction of the first housing. The fixed seat and the mounting seat define the pipe penetration space, and the notch is defined between the valve assembly and the fixed seat and is connected to the pipe penetration space. The notch corresponds to the second housing. The first end of the water outlet pipe is connected to the distal end of the second housing, and the second end of the water outlet pipe is configured to pass through the notch and pass out from the pipe penetration space.

By setting up the countertop mounting assembly and the fixed seat, the countertop mounting assembly can be installed separately onto the countertop first, and then the first housing can be directly connected to the mounting seat, making the installation quick and easy. Additionally, due to a presence of a pipe penetration space, the water outlet pipe can first be connected to the distal end of the second housing, and then passes through the pipe penetration space to extend below the countertop. The water outlet pipe can then be connected to another pipe below the countertop, facilitating the connection. Moreover, an overall appearance of the housing is compact and aesthetically pleasing.

DETAILED DESCRIPTION OF THE EMBODIMENTS

The following will clearly and completely describe the technical solutions in the embodiments of the present disclosure.

Figure 1:
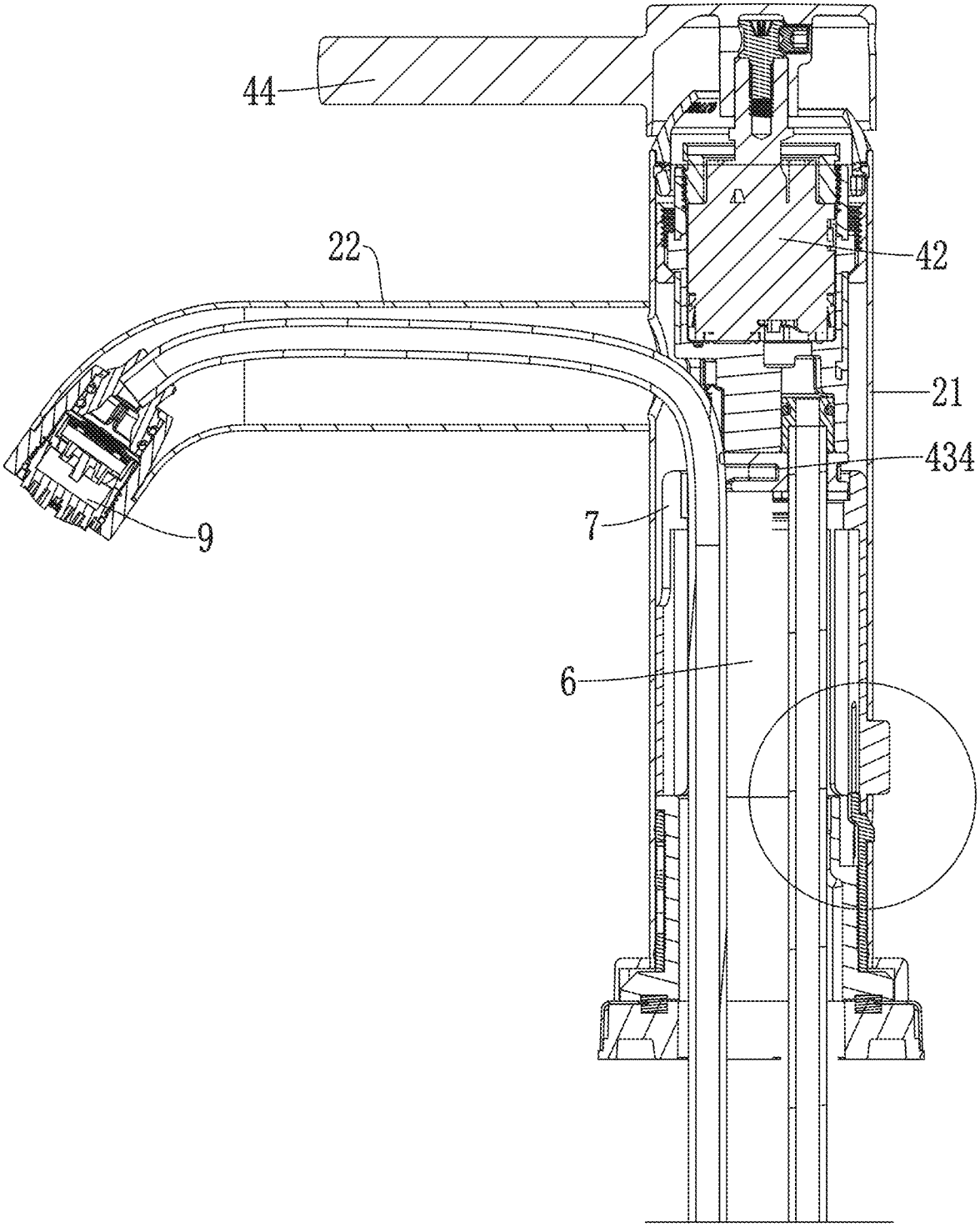
FIG. 1 is a cross-sectional view of a faucet in a preferred embodiment of the present disclosure.
Figure 2:
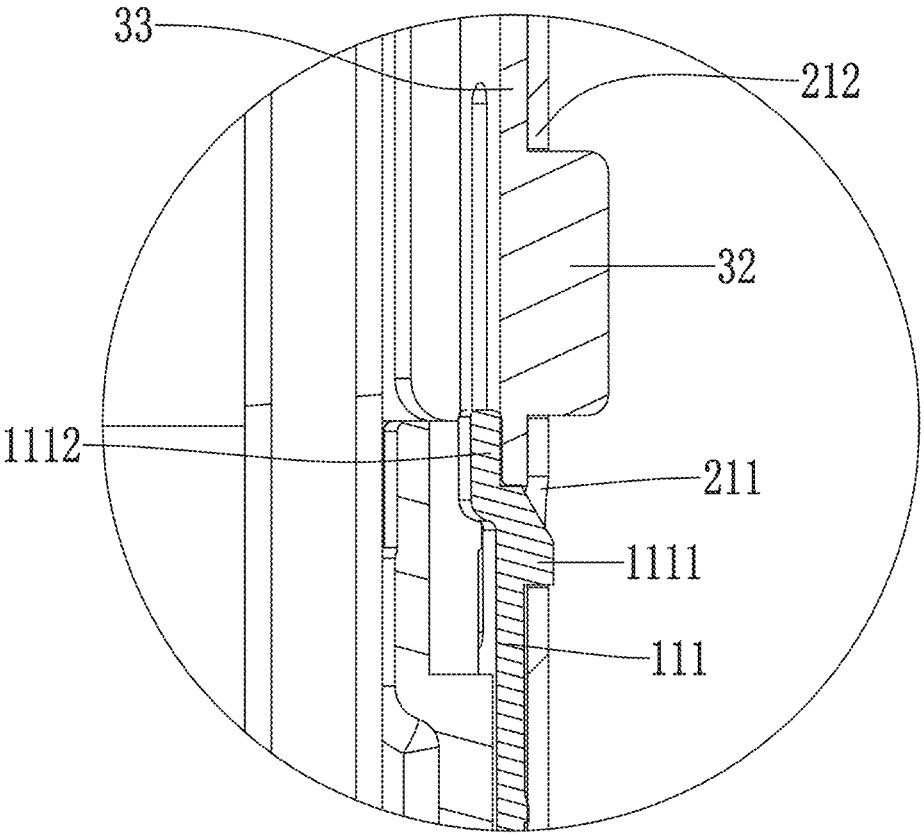
FIG. 2 is an enlarged view of a circled area in FIG. 1.
Figure 3:
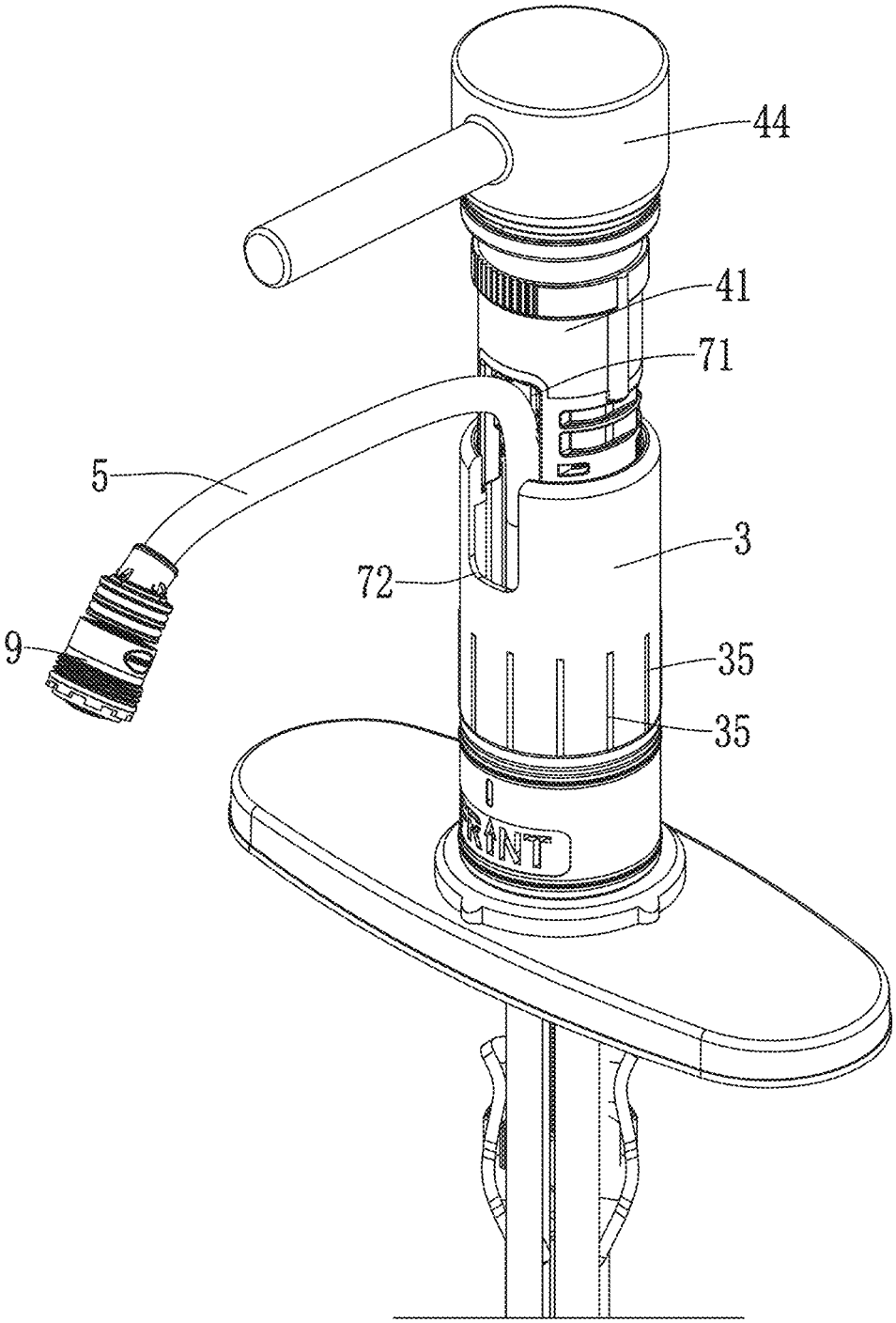
FIG. 3 is a perspective view of the faucet in the preferred embodiment of the present disclosure with a housing removed.
Figure 4:
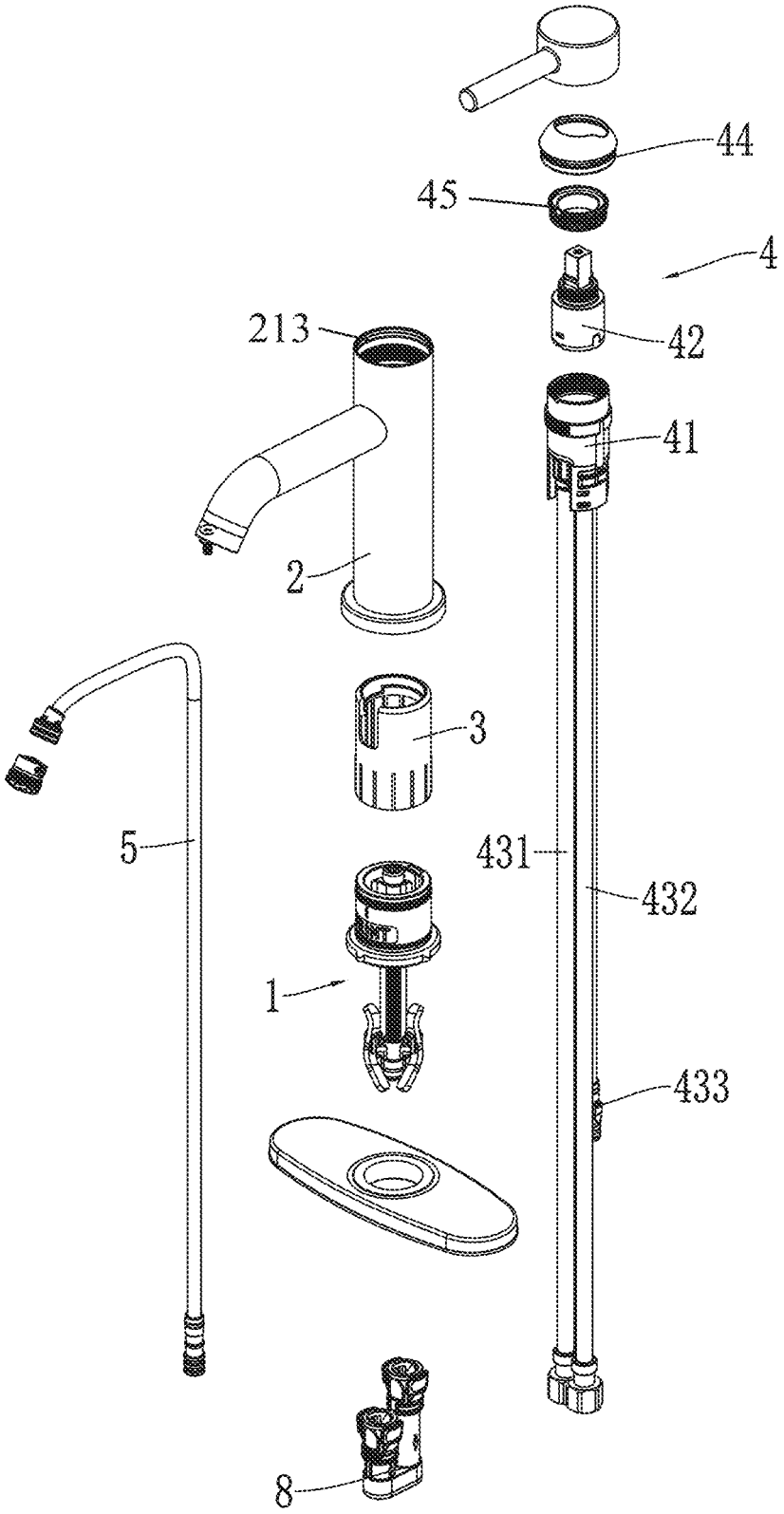
FIG. 4 is an exploded view of the faucet in the preferred embodiment of the present disclosure.
Figure 5:
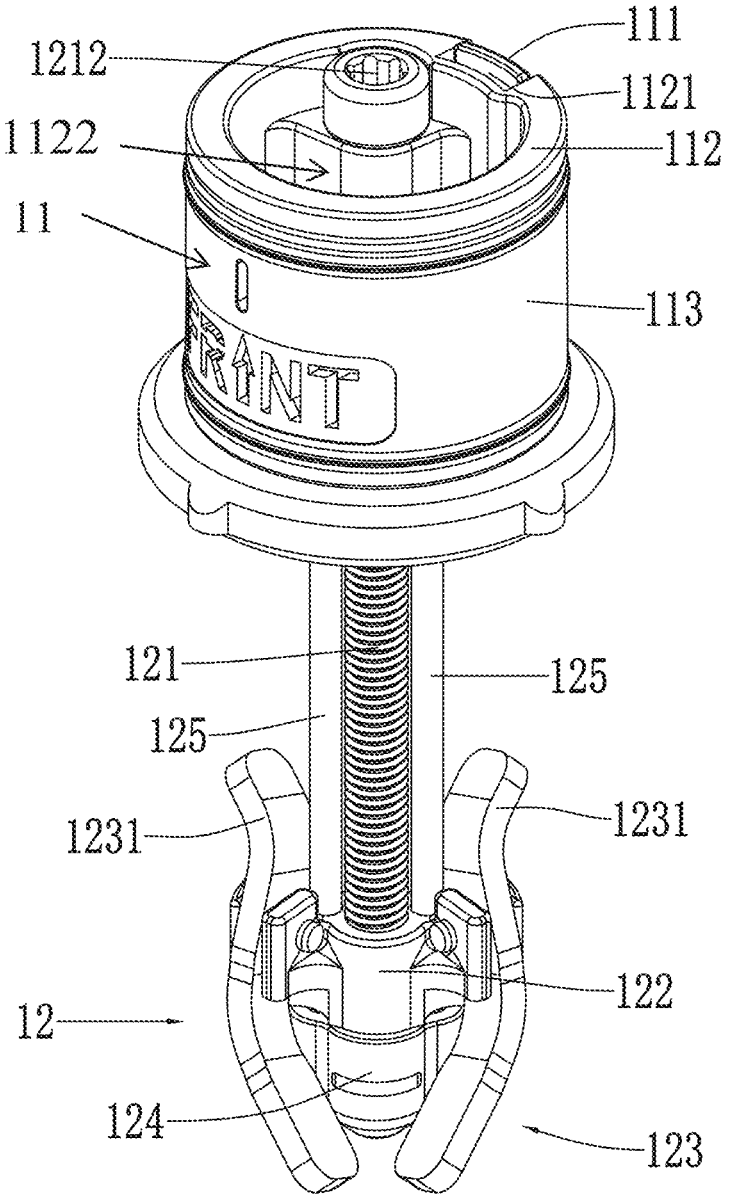
FIG. 5 is a perspective view of a countertop mounting assembly in the preferred embodiment of the present disclosure.
Figure 6:
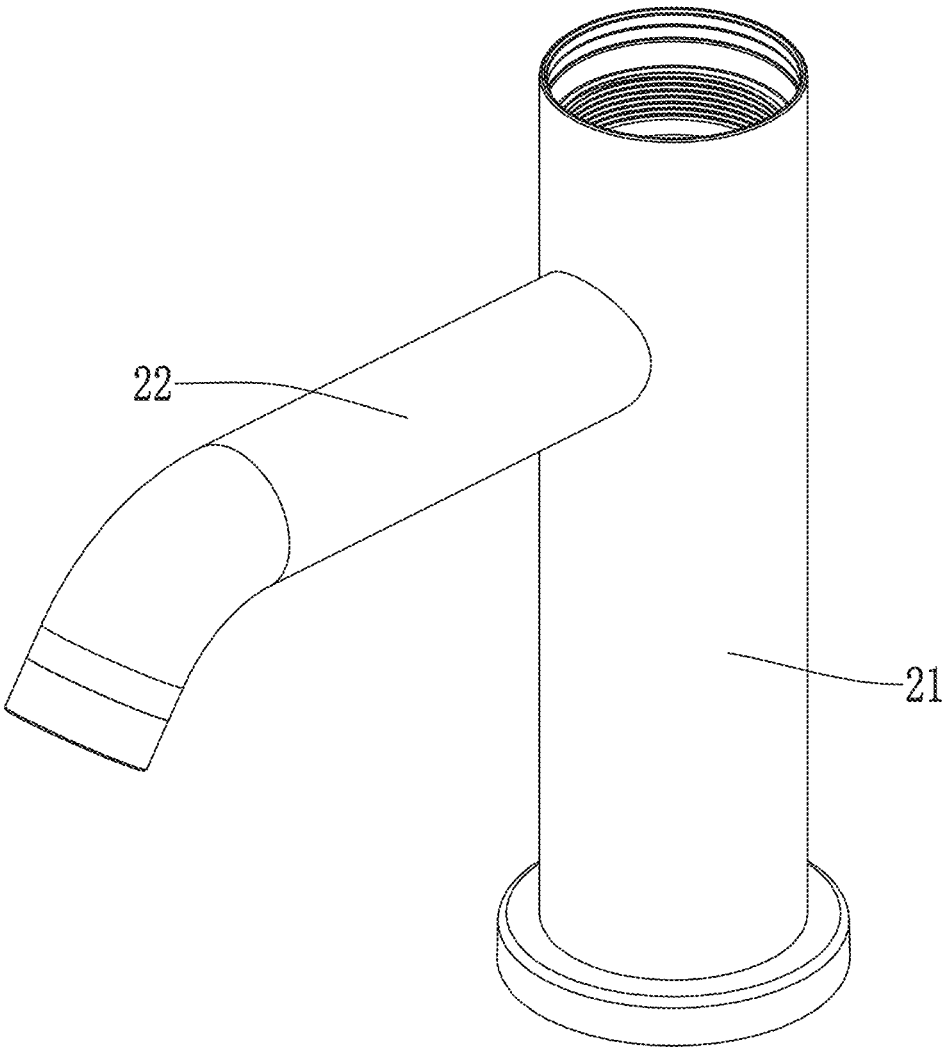
FIG. 6 is a perspective view of the housing in the preferred embodiment of the present disclosure.
Figure 7:
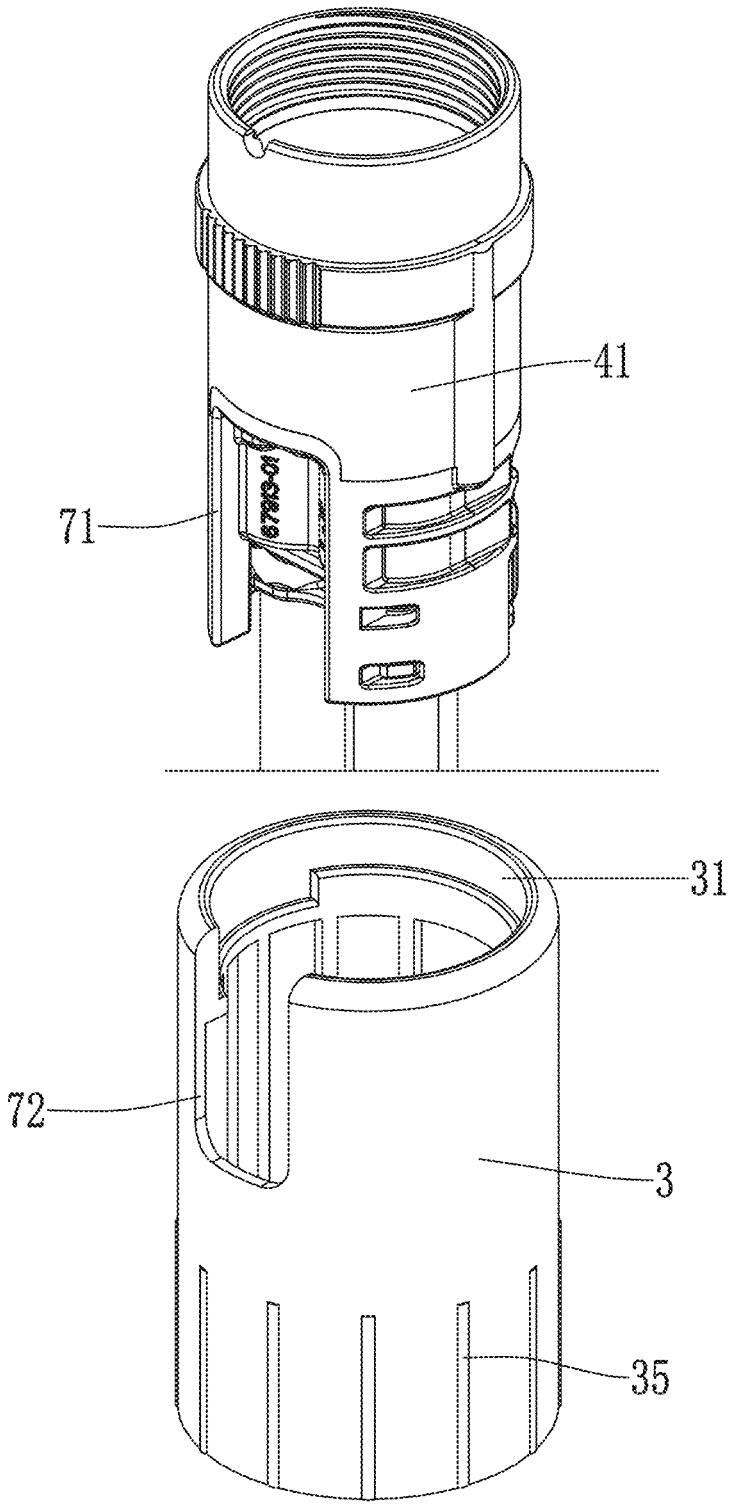
FIG. 7 is a perspective view of a valve seat and a fixed seat in the preferred embodiment of the present disclosure.
Figure 8:
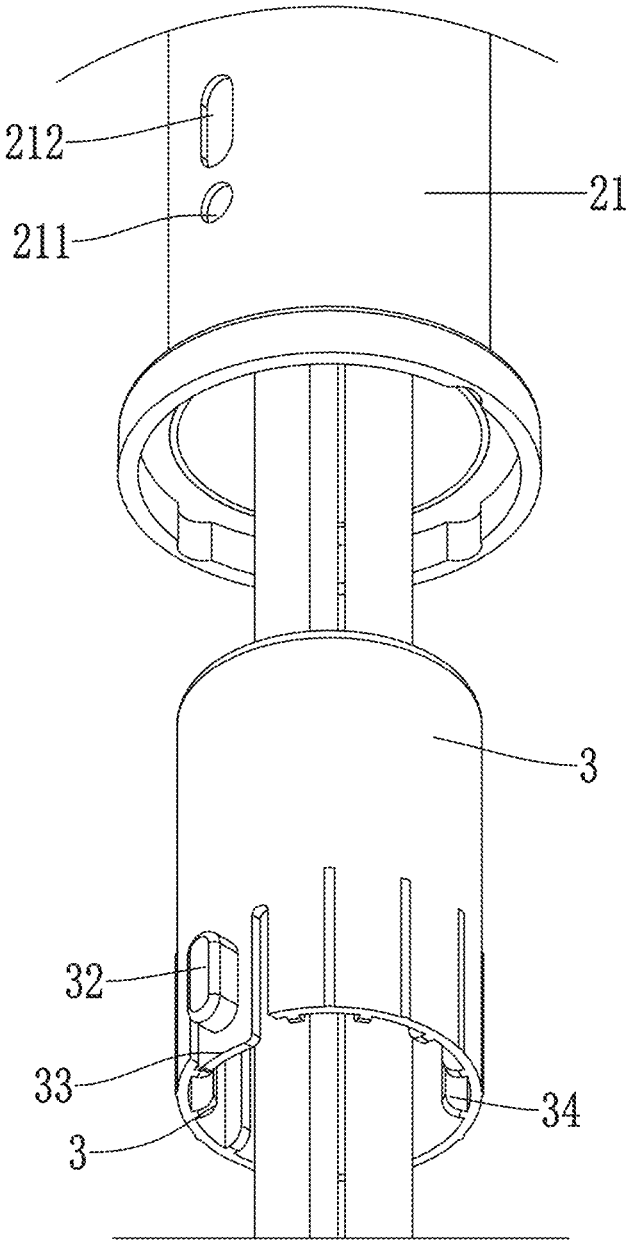
FIG. 8 is a perspective view showing a connection between a first housing and the fixed seat in the preferred embodiment of the present disclosure.
Figure 9:
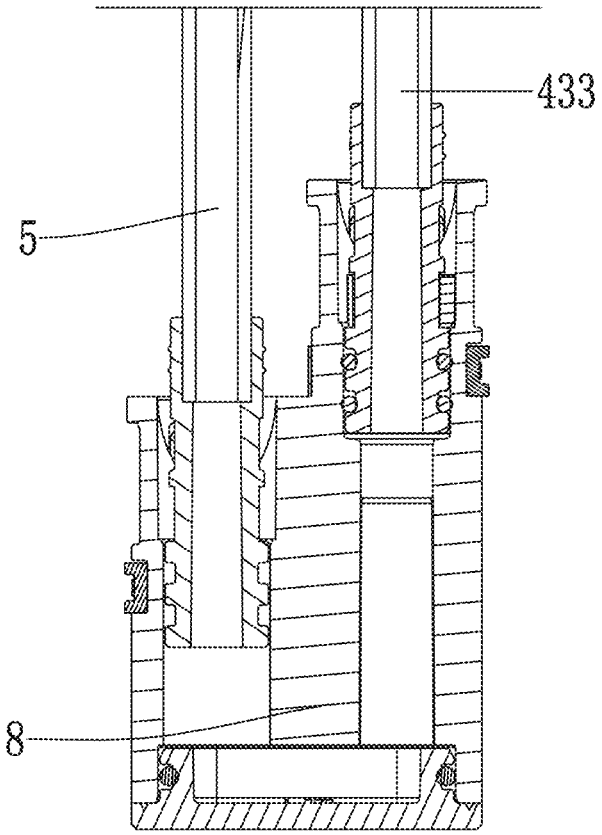
FIG. 9 is a cross-sectional view of a water outlet pipe, a water-mixing pipe, and a connector in the preferred embodiment of the present disclosure.

Referring to FIGS. 1 to 9, a faucet is provided. The faucet comprises a countertop mounting assembly 1, a housing 2, a fixed seat 3, a valve assembly 4, and a water outlet pipe 5.

The countertop mounting assembly 1 comprises a mounting seat 11 and a locking assembly 12, and at least part of the locking assembly 12 is disposed below the mounting seat 11. The mounting seat 11 is operably coupled to the at least part of the locking assembly 12 to drive the at least part of the locking assembly 12 to abut a lower side of a countertop to secure the mounting seat 11 to the countertop.

The housing 2 comprises a first housing 21 and a second housing 22. The first housing 21 extends in a vertical direction, and the second housing 22 is connected to a side of a top part of the first housing 21. In this embodiment, the second housing 22 extends in a horizontal direction by a specific distance, and a water outlet head 9 is mounted at a distal end of the second housing 22.

The first housing 21 defines a hollow structure that penetrates through the first housing 21 from top to bottom, and an internal space of the second housing 22 is connected to an internal space of the first housing 21. A lower end of the first housing 21 is detachably connected to the mounting seat 11, and an upper end of the first housing 21 is detachably connected to the valve assembly 4. In this embodiment, an inner wall of the upper end of the first housing 21 comprises an internal thread structure 213, and the lower end of the first housing 21 comprises a buckle hole 211. The first housing 21 is connected to the valve assembly 4 by threads, and the first housing 21 is connected to the mounting seat 11 by buckles.

The valve assembly 4 comprises a valve seat 41, a valve 42, a pipeline assembly, and a handle assembly 44. The valve seat 41 is in a shape of a cylindrical barrel, and the valve 42 is detachably disposed in the valve seat 41. An inner side of an upper end of the valve seat 41 is connected to a valve pressing lid 45 by threads to secure the valve 42 to the valve seat 41. The handle assembly 44 is connected to the valve 42, and the handle assembly 44 is configured to control the valve 42. The pipeline assembly comprises a first water inlet pipe 431, a second water inlet pipe 432, a water-mixing pipe 433, and a pipe seat 434. A first end of the first water inlet pipe 431 is connected to a hot water source, and a first end of the second water inlet pipe 432 is connected to a cold water source. Each of a second end of the first water inlet pipe 431, a second end of the second water inlet pipe 432, and a first end of the water-mixing pipe 433 is inserted into the valve seat 41, and the pipe seat 434 is configured to secure the second end of the first water inlet pipe 431, the second end of the second water inlet pipe 432, and the first end of the water-mixing pipe 433 to the valve seat 41. The first water inlet pipe 431, the second water inlet pipe 432, and the water-mixing pipe 433 are thus fluidly connected to the valve 42 in the valve seat 41. The valve 42 can receive hot water and cold water from the first water inlet pipe 431 and the second water inlet pipe 432. The valve 42 controls a mixing ratio of the hot water and the cold water through the handle assembly 44 to form mixed water, and the mixed water is controlled by the valve 42 to enter the water-mixing pipe 433. The first water inlet pipe 431, the second water inlet pipe 432, and the water-mixing pipe 433 hang down from a lower end of the valve seat 41 so as to extend from top to bottom.

The fixed seat 3 is in a shape of a cylindrical sleeve, and a receiving recess 31 is formed at an upper end of the fixed seat 3. The lower end of the valve seat 41 can be embedded and spliced into the receiving recess 31. At this time, the valve seat 41 and the receiving recess 31 are spliced along an axial direction of the fixed seat 3. A lower end of the fixed seat 3 comprises a button 32. Specifically, the lower end of the fixed seat 3 comprises a cantilever 33, and the button 32 is disposed on the cantilever 33. The button 32 can be pressed through deformation of the cantilever 33. The lower end of the first housing 21 comprises a button hole 212. The fixed seat 3 can be correspondingly disposed in the lower end of the first housing 21, and the button 32 is correspondingly embedded in the button hole 212. The button 32 can be pressed in the button hole 212. The lower end of the fixed seat 3 can be sleeved outside the mounting seat 11, and an inside of the lower end of the fixed seat 3 comprises a plurality of reinforcing ribs 34 extending inward. An outer wall of the fixed seat 3 further comprises a plurality of ribs 35, and the plurality of ribs 35 abut an inner wall of the first housing 21.

The mounting seat 11 comprises a buckle member 111. The lower end of the first housing 21 can be sleeved outside the mounting seat 11, and the lower end of the first housing 21 comprises the buckle hole 211. When the fixed seat 3 is mounted in the first housing 21, the first housing 21 can be sleeved outside the mounting seat 11 from top to bottom, and the buckle member 111 can be correspondingly buckled to the buckle hole 211.

The lower end of the fixed seat 3 abuts an upper end of the mounting seat 11, so the valve seat 41, the fixed seat 3, and the mounting seat 11 abut one another in sequence along the axial direction of the fixed seat 3.

Through the cantilever 33, the button 32 can be pressed by an external force to move radially inward, and the button 32 is configured to push the buckle member 111 to move radially to leave the buckle hole 211. The buckle member 111 can be elastically deformed to be rotated around a lower end of the buckle member 111. The buckle member 111 comprises a buckle protrusion 1111, and an outer side of an upper end of the buckle member 111 comprises an engaging groove 1112. The cantilever 33 can be elastically deformed to be rotated around an upper end of the cantilever 33, and a lower end of the cantilever 33 is correspondingly engaged with the engaging groove 1112. When the button 32 on the cantilever 33 is pressed by an external force to rotate radially inward, the lower end of the cantilever 33 pushes the upper end of the buckle member 111 to move radially inward so that the buckle protrusion 1111 leaves the buckle hole 211. In this embodiment, the buckle hole 211 and the button hole 212 are arranged side by side along the vertical direction.

The mounting seat 11 comprises a seat body 112 and a connecting sleeve 113. The connecting sleeve 113 is sleeved outside the seat body 112. The first housing 21 is detachably connected to the connecting sleeve 113.

The connecting sleeve 113 is sleeved outside the seat body 112. An outer wall of the seat body 112 comprises a notch groove 1121. The connecting sleeve 113 comprises the buckle member 111. The buckle member 111 can be elastically deformed in a radial direction of the seat body 112 to move into or out of the notch groove 1121.

The seat body 112 comprises a middle through hole 1122, and the first water inlet pipe 431, the second water inlet pipe 432, and the water-mixing pipe 433 are configured to pass through the middle through hole 1122. The locking assembly 12 comprises a threaded column 121, a moving member 122, and an abutting member 123. The threaded column 121 is operably rotatably disposed on the mounting seat 11, and the moving member 122 is screwed on the threaded column 121. When the threaded column 121 is rotated, the moving member 122 can move up and down along the threaded column 121 to abut the lower side of the countertop. The locking assembly 12 comprises a blocking head 124 and two guiding pins 125. The blocking head 124 is located below the mounting seat 11, the two guiding pins 125 are connected to the blocking head 124 and the mounting seat 11, and the moving member 122 is slidably disposed on the two guiding pins 125. The abutting member 123 comprises two rotating rods 1231. The two rotating rods 1231 are respectively rotatably connected to two sides of the moving member 122, and a rotation center of each of the two rotating rods 1231 deviates from a middle position of a corresponding one of the two rotating rods 1231. Therefore, the two rotating rods 1231 will hang down due to gravity. When upper ends of the two rotating rods 1231 abut the lower side of the countertop, the two rotating rods 1231 will rotate accordingly until an entire rod body of each of the two rotating rods 1231 abuts the lower side of the countertop, which is a conventional structure and will not be repeated here. An upper end of the threaded column 121 comprises a connection port 1212. The connection port 1212 is a hexagonal hole. The connection port 1212 is located on an upper side of the mounting seat 11, so the user can directly operate above the countertop to achieve a connection between the locking assembly 12 and the countertop. The countertop is clamped between the mounting seat 11 and the locking assembly 12.

Since the fixed seat 3 is in a shape of the cylindrical sleeve and the seat body 112 comprises the middle through hole 1122, a pipe penetration space 6 is defined by the fixed seat 3 and the mounting seat 11 when the fixed seat 3 and the mounting seat 11 abut each other along the axial direction of the fixed seat 3. The first water inlet pipe 431, the second water inlet pipe 432, the water-mixing pipe 433, and the water outlet pipe 5 can all pass through the pipe penetration space 6 and pass out from a lower end of the mounting seat 11 to a space under the countertop.

A notch 7 is formed when the lower end of the valve seat 41 abuts the upper end of the fixed seat 3, and the notch 7 is connected to the pipe penetration space 6. The notch 7 corresponds to an entrance of the second housing 22. In this embodiment, the notch 7 comprises a first position-providing part 71 and a second position-providing part 72. The lower end of the valve seat 41 comprises the first position-providing part 71, and the fixed seat 3 comprises the second position-providing part 72. The first position-providing part 71 is a groove wall formed on the lower end of the valve seat 41, and a top wall of the groove wall extends to point to the entrance of the second housing 22. The second position-providing part 72 is a through groove. A first end of the water outlet pipe 5 is connected to the water outlet head 9, and a second end of the water outlet pipe 5 extends along the second housing 22 and enters the first housing 21. The water outlet pipe 5 is bent toward the pipe penetration space 6 by the top wall of the groove wall and finally passes through the lower end of the seat body 112.

The water outlet pipe 5 is connected to the water-mixing pipe 433. Specifically, a connector 8 is provided, and the connector 8 is connected to the water outlet pipe 5 and the water-mixing pipe 433 respectively.

During an installation process, the first end of the water outlet pipe 5 is connected to the water outlet head 9, and the second end of the water outlet pipe 5 passes through the second housing 22 into the first housing 21 and passes through the lower end of the first housing 21. The fixed seat 3 is mounted from the lower end of the first housing 21, so that the second end of the water outlet pipe 5 passes through the fixed seat 3 from top to bottom and the button 32 is correspondingly embedded in the button hole 212 and protrudes from the button hole 212. The valve seat 41 is mounted on an upper part of the first housing 21 from top to bottom, so that the groove wall corresponds to the water outlet pipe 5 to enable the water outlet pipe 5 to be bent, and the first water inlet pipe 431, the second water inlet pipe 432, and the water-mixing pipe 433 all pass through the fixed seat 3. The valve 42 and the handle assembly 44 are then connected in sequence. The countertop mounting assembly 1 is mounted on the countertop, and the first housing 21 is correspondingly sleeved on the mounting seat 11 from top to bottom, so that the buckle member 111 is buckled to the buckle hole 211. Finally, the connector 8 is respectively connected to the water outlet pipe 5 and the water-mixing pipe 433. When disassembly is required, the button 32 can be pressed to realize disassembly.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A faucet, comprising:
a housing,
a countertop mounting assembly,
a fixed seat,
a valve assembly, and
a water outlet pipe, wherein:
the housing comprises a first housing and a second housing,
one end of the second housing is connected to a side of a top part of the first housing,
the countertop mounting assembly comprises a mounting seat and a locking assembly,
at least part of the locking assembly is disposed below the mounting seat,
the mounting seat is operatively coupled to the at least part of the locking assembly to drive the at least part of the locking assembly to abut a lower side of a countertop to secure the mounting seat to the countertop,
the valve assembly is disposed on an upper end of the first housing,
the fixed seat is disposed on a lower end of the first housing,
the lower end of the first housing is detachably sleeved on the mounting seat,
the valve assembly, the fixed seat, and the mounting seat are arranged in sequence along an axial direction of the first housing,
the fixed seat and the mounting seat define a pipe penetration space,
a notch is defined between the valve assembly and the fixed seat and is connected to the pipe penetration space,
the notch corresponds to the second housing,
a first end of the water outlet pipe is connected to a distal end of the second housing, and
a second end of the water outlet pipe is configured to pass through the notch and pass out from the pipe penetration space.

2. The faucet according to claim 1, wherein:
the notch comprises a first position-providing part and a second position-providing part,
a lower end of the valve assembly comprises the first position-providing part,
the fixed seat comprises the second position-providing part,
the first position-providing part is a groove wall formed on the lower end of the valve assembly, and
the second position-providing part is a through groove.

3. The faucet according to claim 2, wherein:
a top wall of the groove wall extends to point to an entrance of the second housing.

4. The faucet according to claim 1, wherein:
the valve assembly comprises a valve seat, at least one water inlet pipe, and a water-mixing pipe,
the valve seat is configured to abut the fixed seat,
the at least one water inlet pipe and the water-mixing pipe are connected to the valve seat,
the at least one water inlet pipe and the water-mixing pipe are configured to pass out from the pipe penetration space, and
the water-mixing pipe is detachably connected to the water outlet pipe.

5. The faucet according to claim 4, comprising:
a connector, wherein:
the connector is respectively detachably connected to the water outlet pipe and the water-mixing pipe.

6. The faucet according to claim 1, wherein:
the mounting seat comprises a buckle member,
the lower end of the first housing is configured to be sleeved outside the mounting seat,
the lower end of the first housing comprises a buckle hole, and
the buckle member is operatively buckled to the buckle hole.

7. The faucet according to claim 6, wherein:
the fixed seat comprises a cantilever,
the cantilever is disposed with a button,
the button is configured to be pressed by an external force to enable the cantilever to move radially inward,
the cantilever is configured to push the buckle member to move radially to leave the buckle hole,
the buckle member is configured to be elastically deformed to be rotated around a lower end of the buckle member,
the buckle member comprises a buckle protrusion,
an outer side of an upper end of the buckle member comprises an engaging groove,
the cantilever is configured to be elastically deformed to be rotated around an upper end of the cantilever,
a lower end of the cantilever is correspondingly engaged with the engaging groove, and
when the button on the cantilever is pressed by the external force to rotate radially inward, the lower end of the cantilever pushes the upper end of the buckle member to move radially inward so that the buckle protrusion leaves the buckle hole.

8. The faucet according to claim 6, wherein:
the lower end of the first housing comprises a button hole, and a button of a cantilever of the fixed seat protrudes from the button hole to enable the fixed seat to be detachably connected to the first housing.

9. The faucet according to claim 8, wherein:

the buckle hole and the button hole are arranged side by side along a vertical direction of the faucet.

10. The faucet according to claim 8, wherein:

an outer wall of the fixed seat further comprises a plurality of ribs, and the plurality of ribs abut an inner wall of the first housing.

11. The faucet according to claim 1, wherein:

the locking assembly comprises a threaded column, a moving member, an abutting member, a blocking head, and two guiding pins, the threaded column is operably rotatably disposed on the mounting seat, the moving member is screwed on the threaded column, when the threaded column is rotated, the moving member is configured to move up and down along the threaded column to abut the lower side of the countertop, the blocking head is located below the mounting seat, the two guiding pins are connected to the blocking head and the mounting seat, the moving member is slidably disposed on the two guiding pins, the abutting member comprises two rotating rods, the two rotating rods are respectively rotatably connected to two sides of the moving member, and a rotation center of each of the two rotating rods deviates from a middle position of a corresponding one of the two rotating rods.

* * * * *